United States Patent [19]

Difley et al.

[11] 4,023,875

[45] May 17, 1977

[54] EASY OPEN COMPACTOR DRAWER

[75] Inventors: Charles Rogers Difley; William Roy McDonald, both of Danville, Ky.

[73] Assignee: Whirlpool Corporation, Benton Harbor, Mich.

[22] Filed: July 24, 1975

[21] Appl. No.: 599,010

[52] U.S. Cl. ..... 312/319; 312/270; 312/333; 100/100

[51] Int. Cl.² ..... B30B 15/00; A47B 51/00

[58] Field of Search ..... 312/319, 270, 271, 211, 312/139, 333; 100/100; 292/94, DIG. 25, DIG. 71, 336.3

[56] References Cited

UNITED STATES PATENTS

| | | | |
|---|---|---|---|
| 508,327 | 11/1893 | Lippincott | 312/333 |
| 952,573 | 3/1910 | Munger | 312/319 |
| 1,172,711 | 2/1916 | Hunter | 312/333 |
| 1,204,072 | 11/1916 | Royack | 292/94 |
| 1,450,974 | 4/1923 | Heotes | 312/333 |
| 1,560,887 | 11/1925 | Watson | 312/333 |
| 1,784,588 | 12/1930 | Green | 312/319 |
| 2,777,315 | 1/1957 | Burke | 292/DIG. 71 |
| 2,813,771 | 11/1957 | Selmer | 312/270 |
| 2,928,690 | 3/1960 | Larson | 292/336.3 |
| 2,934,390 | 4/1960 | Wright | 312/270 |
| 3,012,837 | 12/1961 | Morrissey et al. | 312/319 |
| 3,041,124 | 6/1962 | Armstrong | 312/270 |
| 3,726,211 | 4/1973 | Gladwin | 100/100 |
| 3,868,903 | 3/1975 | Montalbano | 100/100 |

*Primary Examiner*—Paul R. Gilliam
*Assistant Examiner*—Victor N. Sakran
*Attorney, Agent, or Firm*—Wegner, Stellman, McCord, Wiles & Wood

[57] ABSTRACT

A refuse compactor having a refuse holding receptacle and structure for effecting movement of the receptacle from a retracted position to an exposed position. The receptacle moving structure is arranged to draw the receptacle upwardly from the retracted position and urge the receptacle toward the exposed position. Further structure may be provided for urging the receptacle to the exposed position upon drawing of the receptacle from the retracted position.

16 Claims, 11 Drawing Figures

10
11
12
13
14
15
16
17
18
20
20'
21
22
22a
24
25
26
27
28
29
30
33
36
37
38
39
40
41
42
45
2.
3.
4.
5.

EASY OPEN COMPACTOR DRAWER

BACKGROUND OF THE INVENTION

1. Field of the Invention

This invention relates to refuse compactors, and, in particular, to means for facilitating movement of the refuse holder from a retracted position to an exposed position.

2. Description of the Prior Art

In one conventional form of refuse compactor, the refuse holder comprises a drawer which is movably carried in a cabinet to be selectively disposed in a compacting position fully within the cabinet and resting on a base support thereof, and an exposed loading position outwardly of the cabinet wherein refuse may be introduced into the drawer for subsequent compaction by suitable ram means upon return of the drawer to the compacting position.

Such compactors provide for the temporary retention of a substantial amount of refuse, thereby facilitating the handling of refuse such as in domestic applications and the like. One problem, however, arises in such use in that a relatively heavy mass of compacted refuse may be accumulated in the drawer before it is necessary to transfer the compacted refuse therefrom for disposal, thereby requiring a substantial force in moving the drawer from the compacting position.

Further, when depositing refuse in the receptacle, the user may frequently have both hands occupied with the carrying of the refuse, thus causing some difficulty in moving the drawer to the refuse loading position.

The use of pedal released, spring-biased receptacles in garbage disposal units is illustrated broadly in the Alois Selmer U.S. Pat. No. 2,699,368. As disclosed therein, a pedal structure is mounted to the cabinet and causes movement of the carriage when operated. Concurrently, the pedal effects a lifting of a cover member from the container to retain the cover member above the container until the container is restored to the retracted position. The carriage is held in the retracted position against a tension spring by engagement of a protuberance with a catch which is released by operation of the pedal. Upon such release, the spring effects the desired movement of the carriage from the cabinet.

In Alois Selmer's U.S. Pat. No. 2,813,771, a garbage disposal unit is illustrated, having a modified form of pedal which elevates the rear end of a platform to incline the platform and thereby cause the carriage to slide outwardly from the cabinet.

In U.S. Pat. No. 2,934,390 of Walter P. Wright, a garbage receptacle is shown provided with a pedal mechanism for moving the receptacle from inside the compartment to an extended position outwardly of the compartment, while concurrently raising the cover.

In U.S. Pat. No. 3,183,050 of Archie C. Hudson, garbage disposal units are disclosed wherein a pedal mechanism is provided for projecting the carriage and receptacle outwardly from the cabinet and raising the lid of the receptacle as the receptacle is moved forwardly. Connecting rods are provided to push on the container as a result of the operation of the foot pedal, to move the carriage on a slide device to the exposed position.

The Floyd R. Gladwin U.S. Pat. No. 3,726,211 shows the use of a foot pedal in a trash compactor. A foot pedal is provided for retracting locking pins and permitting the return of the dolly into the cabinet. Closing of the door causes the locking of the dolly in the compacting position.

In U.S. Pat. No. 3,754,503 of Ransom J. Hennells, a waste compactor is provided with a foot actuated release mechanism which permits the receptacle to be lifted upwardly from the cabinet floor and release hinges on the cabinet to permit the receptacle to be swingably moved into an emptying position.

SUMMARY OF THE INVENTION

The present invention comprehends an improved refuse compactor drawer movement means wherein a foot pedal is carried on the drawer for cooperation with a reaction means carried on the drawer support to effect an improved, facilitated movement of the drawer from the retracted position.

A manual operating handle may be associated with the foot pedal to permit selectively manual or foot opening of the drawer. The movement of the drawer effected by the operation of the operating member against the reaction means may draw the drawer upwardly and concurrently outwardly from the retracted position. Suitable spring means may be further provided for urging the drawer further to the exposed loading position.

The foot pedal is arranged to move the user's foot out of the way as a concomitant of the opening movement of the drawer. The drawer may be mounted on suitable rollers for facilitated movement by the pedal means and spring means. Alternately, the roller track may be mounted suitably sloped toward the exposed position for urging the drawer toward the exposed position after the pedal has been acutated instead of a spring means.

The drawer moving means of the present invention is extremely simple and economical of construction, while yet providing an improved, facilitated opening of the drawer when desired.

BRIEF DESCRIPTION OF THE DRAWING

Other features and advantages of the invention will be apparent from the description taken in connection with the accompanying drawing, wherein.

DESCRIPTION OF THE PREFERRED EMBODIMENT

Figures 1, 2, 3, 4:
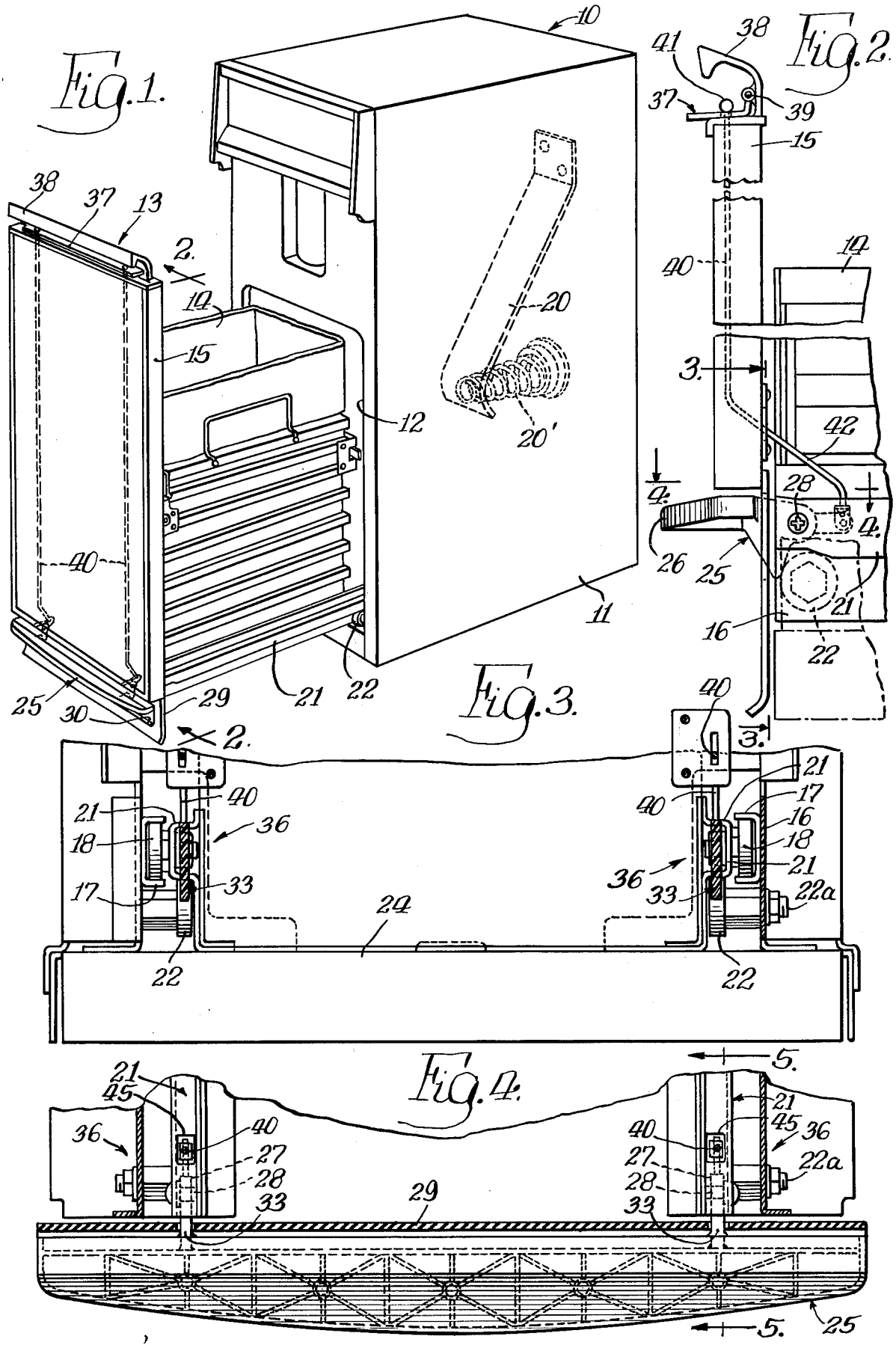
FIG. 1 is a perspective view of a refuse compactor having drawer opening means embodying the invention.
FIG. 2 is a fragmentary enlarged vertical section taken substantially along the line 2—2 of FIG. 1.
FIG. 3 is a fragmentary vertical section taken substantially along the line 3—3 of FIG. 2.
FIG. 4 is a fragmentary horizontal section taken substantially along the line 4—4 of FIG. 2.

In the exemplary embodiments of the invention as disclosed in the drawing, a refuse compactor generally designated 10 is shown to comprise a cabinet 11 defining a front opening 12 through which is selectively movable as refuse receiver generally designated 13. In the illustrated embodiment, refuse receiver 13 comprises a drawer 14 provided with a front wall 15 which closes the opening 12 when the drawer is fully inserted into the cabinet.

Cabinet 11 defines a lower support portion 16 which carries a pair of tracks 17 at opposite sides of the drawer. Drawer 14 is provided with suitable rollers 18 cooperating with tracks 17 for facilitated movement of the drawer from the fully retracted position to an exposed refuse-receiving position illustrated in FIG. 1.

Figures 5, 6, 7, 8:
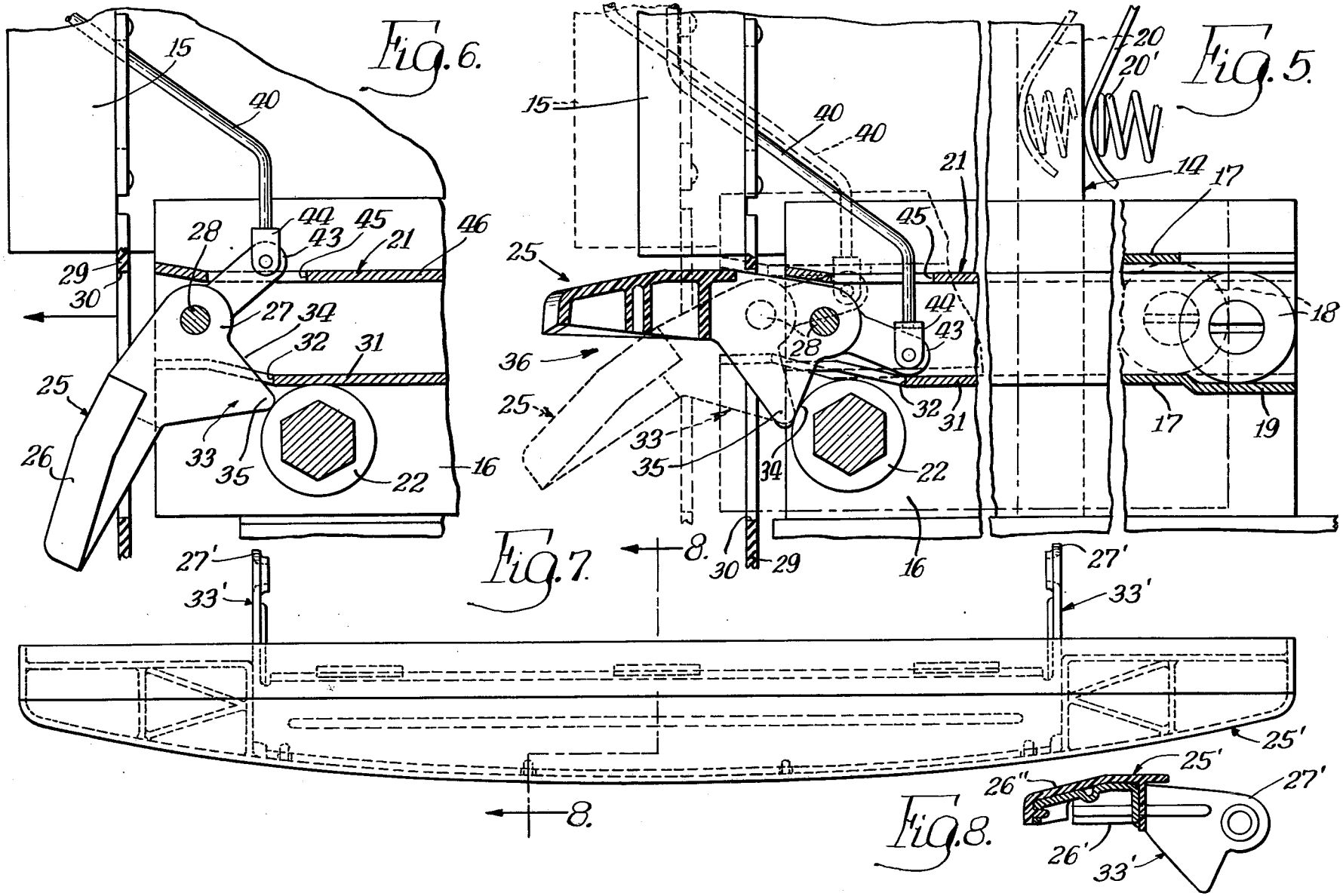
FIG. 5 is a fragmentary enlarged vertical section taken substantially along the line 5—5 of FIG. 4.
FIG. 6 is a fragmentary vertical section of a portion of the structure of FIG. 5, with the foot pedal in a depressed position.
FIG. 7 is a fragmentary top plan view of an alternate foot pedal.
FIG. 8 is a vertical section taken substantially along the line 8—8 of FIG. 7.

As shown in FIG. 5, track 17 defines a depressed portion 19 at the rear end thereof for receiving the roller 18 when the drawer is in the fully retracted position. Thus, the drawer is releasably retained in the retracted position by the cooperative action of the roller and track portion 19, notwithstanding the application of a biasing force urging the drawer outwardly as by a biasing spring 20 mounted to the cabinet rearwardly of the drawer.

A pair of tracks 21 is secured one each to the opposite sides of drawer 14. As shown in FIGS. 1 and 3, tracks 21 extend forwardly from roller 18 and rest on a roller 22 carried on support 16 by a suitable bolt mounting means **22*a* at the front of the cabinet. Track 21 defines an inclined front flange portion 23 which, when the drawer is fully inserted into the cabinet in cooperation with recess 19 of track 17, permits the drawer to drop downwardly onto the base 24 of the cabinet for positively supporting the drawer during the compacting operation wherein high forces are generated by suitable ram means (not shown) acting downwardly on the refuse placed in the drawer. Thus, the compacting forces are resisted by the base 24 rather than by the rollers 18 and 22. Further, reception of roller 22 in the recess defined by the inclined portion 23 of track 21 releasably retains the drawer in the fully inserted position against the action of spring 20 in cooperation with the recess 19** discussed above.

In the embodiment of FIGS. 1 – 8, roller 22 further comprises a reaction means, or reaction member, which is utilized in cooperation with a foot pedal generally designated 25 to effect movement of the drawer from the fully inserted position toward the exposed position of FIG. 1. As may best be seen in FIG. 6, foot pedal 25 includes an operating portion 26 adapted to be engaged by the user's foot. The pedal further includes a mounting portion 27 which is pivotally mounted to the drawer within the front end of track 21 on a suitable pivot 28 for pivoting of the pedal about a horizontal axis rearwardly of the front wall 15 of the drawer.

Front wall 15 includes a depending, preferably flexible, toe plate 29 provided with an opening 30 accommodating the pivotal movement of the pedal in swinging between a ready position shown in full time lines in FIG. 5, and a drawer moving position shown in dotted lines therein. The pedal may swing beyond the operating position of FIG. 5 to the fully depressed position shown in FIG. 6 in moving the drawer outwardly from the fully inserted position.

As further shown in FIG. 6, the lower flange 31 of the track 21 is provided with an opening 32 permitting movement of a bearing portion 33 of the foot pedal about the axis of pivot 28 and against roller 22, as illustrated in FIGS. 5 and 6. The bearing portion defines an inner edge portion 34 and a nose portion 35. In the ready position of the pedal as shown in FIG. 5, edge portion 34 engages the roller slightly above the horizontal diameter thereof, and as the pedal is depressed to the drawer moving position shown in dotted lines in FIG. 5 and beyond to the fully depressed position shown in FIG. 6, nose portion 35 moves along the roller to draw the front end of the drawer upwardly and urge it outwardly, or to the left as seen in FIGS. 5 and 6, as a result of the force applied against the reaction member roller 22 by the pedal bearing portion 33. As shown in FIGS. 1 and 4, the pedal extends fully across the lower end of drawer front wall 15. A pair of reaction members 22 and pedal bearing portions 33 are provided at opposite sides of the drawer to provide a drawer moving operation at both such sides as a result of the depression of the foot pedal anywhere along its horizontal extent. Each such structure effectively defines a means generally designated 36 for facilitating movement of the drawer from the retracted position to the exposed position, and the description of the structure thereof given above is equally applicable to each of the left and right hand means 36, except that the elements are arranged as mirror images of each other.

At times it may be more convenient for the user to open the drawer by hand operation rather than by a foot pedal operation. To permit such utilization of the drawer opening means 36, a manual operator 37 is provided within a handle 38 provided on the top of the drawer wall 15, as shown in FIG. 2. Manual operator 37 may be pivotally mounted to the handle 38 by a pivot 39, and is connected to the foot pedal 25 by vertically extending connecting rods 40 and having a top portion 41 connected to the manual operator 37 and a lower portion 42 movably secured to a rearward extension 43 of the pedal 25 by a pivot connector 44. Extension 43 extends upwardly through a slot 45 in the upper flange 46 of track 21, as shown in FIG. 6. As illustrated in FIGS. 2 and 5, a clockwise movement of manual operator 37 by a grasping action of the user between the manual operator and handle 38 causes a lifting of the connecting rod 40 to swing the pedal extension 43 in a counterclockwise direction from the full line position of FIG. 5 to the dotted line position thereof, thereby drawing the front of the drawer upwardly and urging the drawer outwardly through the cabinet opening 12 in a manner similar to the movement effected by the depression of the foot pedal to the dotted line position of FIG. 5 described above. Continued movement of the manual operator in the clockwise direction causes the pedal bearing nose portion 35 to move along the roller in moving the drawer further outwardly from the cabinet, as illustrated in FIG. 6, and permit spring 20 to effect the desired full movement of the drawer to the exposed position of FIG. 1.

The pedal 25 shown in FIGS. 1 – 6 is a one-piece molded element formed of an injected molded plastic material which, by way of example, may be an acetal such as Delrin. An alternate pedal construction 25′ is shown in FIGS. 7 and 8. Pedal 25′ comprises a sheet metal base portion 26′ which includes mounting portions 27′ and bearing portions 33′. Pedal 25′ is further provided with a suitable decorative cover 26″ which snaps onto base portion 26′ to form a complete pedal assembly.

Figure 9:
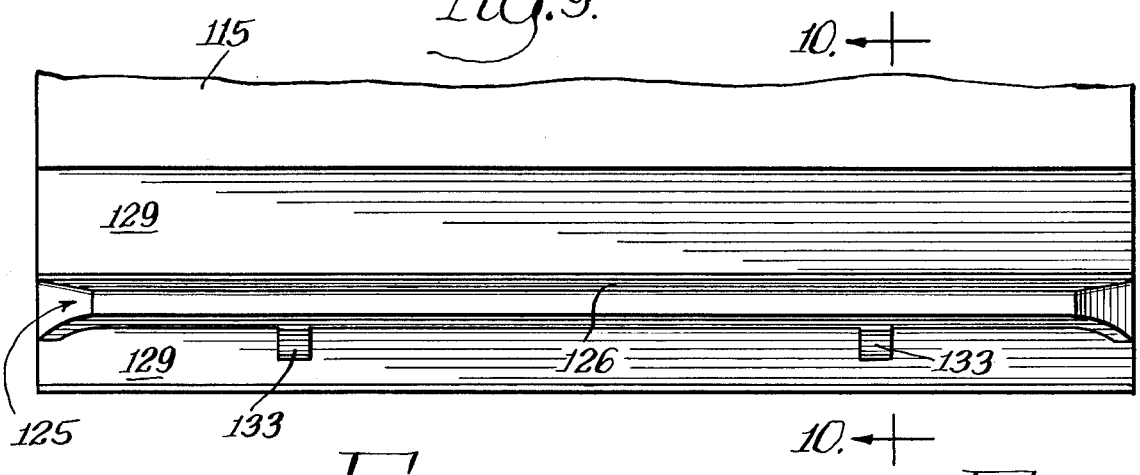
FIG. 9 is a fragmentary front view of a refuse compactor having drawer opening means illustrating another embodiment of the invention.
Figure 10:
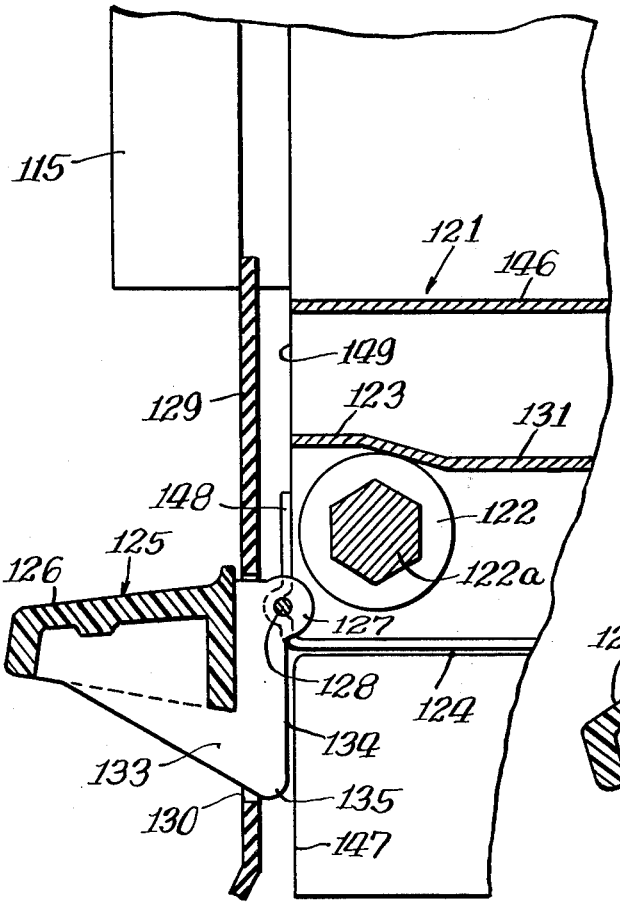
FIG. 10 is a fragmentary enlarged vertical section taken substantially along the line 10—10 of FIG. 9.
Figure 11:
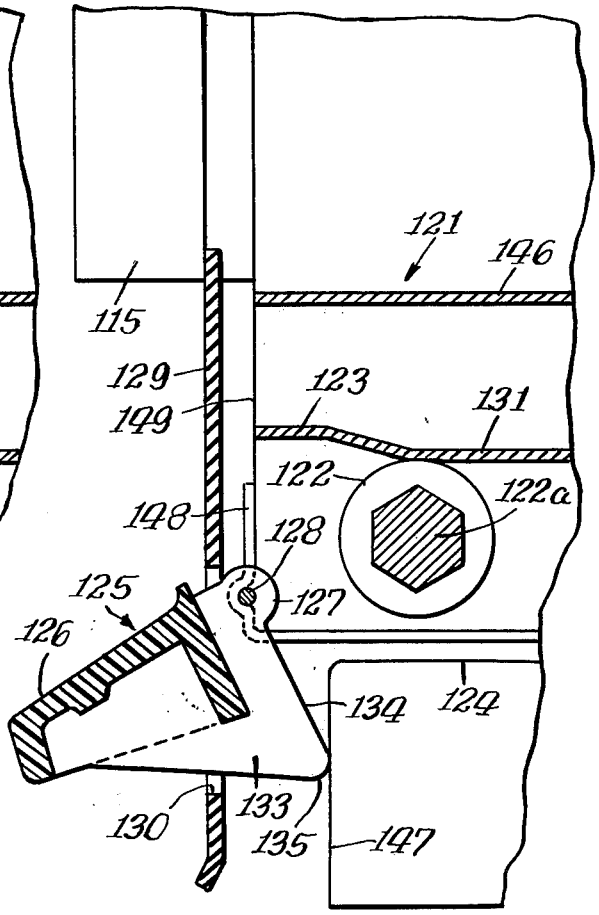
FIG. 11 is a fragmentary enlarged vertical section taken substantially along the line 10—10 of FIG. 9 with the foot pedal depressed.

In the embodiment of FIGS. 9 to 11, the front edge 147 of base 124 comprises a reaction means, or reaction member, which is utilized in cooperation with a foot pedal generally designated 125 to effect movement of the drawer from the fully inserted position toward the exposed position. As may be seen in FIG. 10, foot pedal 125 includes an operating portion 126 adapted to be engaged by the user's foot. The pedal further includes a mounting portion 127 which is pivotally mounted to the drawer front portion 149 on a suitable pivot 128 for pivoting of the pedal about a horizontal axis rearwardly of the front wall 115 of the drawer. Retainer means 148 is provided on drawer front portion 149 to secure pivot 128 to the drawer.

Front wall 115 includes a depending, preferably flexible, toe plate 129 provided with an opening 130 accommodating the pivotal movement of the pedal in swinging between the position shown in FIG. 10, and the downwardly pivoted position in FIG. 11.

The bearing portion 133 of the foot pedal defines an inner edge portion 134 and a nose portion 135. In the ready position of the pedal as shown in FIG. 10, edge portion 134 engages the front wall 147 of base 124, and as the pedal is depressed to the drawer moving position shown in FIG. 11, nose portion 135 moves along the front wall 147 to draw the front end of the drawer upwardly and urge it outwardly as a result of the force applied against the reaction member base 124 by the pedal bearing portion 133. As shown in FIG. 9, the pedal extends fully across the lower end of drawer front wall 115 in front of toe plate 129. A pedal bearing portion 133 is provided at opposite sides of the drawer to provide a drawer moving operation at both such sides as a result of the depression of the foot pedal anywhere along its horizontal extent.

Thus, the present invention comprehends an improved drawer moving means for use in a refuse compactor arranged to automatically dispose the drawer in a supported position on the base of the cabinet in the retracted position wherein the drawer is fully inserted into the cabinet, and to permit facilitated movement of the drawer from the retracted position by drawing of the drawer upwardly from the base and concurrently urging of the drawer outwardly from the cabinet as an incident of a simple foot pedal or manual grasping action. The stored energy in spring 20 provides further movement of the drawer so as to effect a complete opening of the drawer to the refuse-receiving exposed position of FIG. 1. The spring 20 is shown as a leaf spring. Alternately, a coil spring illustrated at 20 could be used. Further, spring means such as springs 20 and 20 may be replaced by a suitable slope in tracks 17 and 21 so that when the drawer is drawn upwardly onto the tracks and urged toward the exposed position, the force of gravity tends to cause the drawer to roll to the exposed position.

As the operating members of the drawing and movement initiating means are carried on the drawer, the user's foot and hand are automatically moved out of the way by the forward movement of the drawer to prevent a striking thereof by what may be a relatively heavy drawer, as may occur in the prior art structures wherein release mechanisms have been mounted on the cabinet structure.

The foregoing disclosure of specific embodiments is illustrative of the broad inventive concepts comprehended by the invention.

Having described the invention, the embodiments of the invention in which an exclusive property or privilege is claimed are defined as follows:

1. In a refuse compactor having a drawer for holding refuse, a base, and support means for movably carrying the drawer for selective disposition in a retracted, compacting position wherein the drawer rests on the base and an exposed refuse loading position, means for effecting movement of the drawer from the retracted position toward the exposed position comprising:

reaction means adjacent said drawer; and an operating member movably carried by said drawer for selective engagement with said reaction means when said drawer is in said retracted position to draw said drawer upwardly from the base and concurrently urge said drawer away from said retracted position on said support means toward said exposed position, said operating member moving with said drawer selectively away from and toward said reaction means.

2. The refuse compactor means of claim 1 wherein said operating member comprises a foot pedal.

3. The refuse compactor means of claim 1 wherein said operating member comprises a manually operable member.

4. The refuse compactor means of claim 1 wherein said drawer is provided with a manipulating handle for use in moving the drawer on said support means and said operating member comprises manually operable means disposed adjacent said handle.

5. The refuse compactor means of claim 1 further including means on said drawer for cooperation with said reaction means for releasably retaining said drawer in said retracted position.

6. The refuse compactor means of claim 1 further including biasing means for urging the drawer toward said exposed position outwardly from said retracted position.

7. The refuse compactor means of claim 1 wherein said operating member comprises a foot pedal means pivotally mounted to the front of said drawer adjacent said reaction means on said support means.

8. The refuse compactor means of claim 7 wherein said foot pedal includes an operating portion adapted to be contacted by a user's foot, a mounting portion adapted to be pivotally attached to the front of said drawer about a horizontal axis, and a bearing portion adapted to engage said reaction means as the pedal is depressed.

9. In a refuse compactor having a drawer for holding refuse, a base, and roller means carried by said base for movably carrying the drawer for selective disposition in a retracted, compacting position wherein the drawer rests on the base and an exposed refuse loading position, means for effecting movement of the drawer from the retracted position toward the exposed position comprising: an operating member movable with said drawer to be disposed adjacent said roller means when said drawer is in said retracted position and operable to engage the roller means to lift said drawer upwardly from the base adjacent said roller means and concurrently urge said drawer away from said retracted position toward said exposed position, said roller means further movably supporting the drawer when the drawer is in other than said retracted position, and said roller means further defining retaining means for releasably retaining said drawer in said retracted position prior to operation of said operating member to lift said drawer upwardly and urge said drawer therefrom.

10. The refuse compactor means of claim 9 wherein said drawer is provided with means defining a recess for receiving said roller means in said retracted position.

11. The refuse compactor means of claim 9 wherein said operating member is pivotally mounted to said drawer to engage an upper portion of the roller means in drawing said drawer from said retracted position.

12. The refuse compactor means of claim 9 wherein a second operating member is provided for selectively effecting drawing and urging of said drawer from said retracted position.

13. The refuse compactor means of claim 9 wherein said operating member comprises a foot pedal means, a manually operable, second operating member being provided for selectively alternately effecting said drawing and urging of said drawer from said retracted position.

14. In a refuse compactor having a drawer for holding refuse, a base, and support means for movably carrying the drawer on the base for selective disposition in a retracted compacting position wherein the drawer rests on the base and an exposed refuse loading position wherein the drawer is carried on the support means, means for effecting movement of the drawer from the retracted position toward the exposed position comprising: reaction means adjacent said drawer; and an operating member pivotally mounted to said drawer adjacent said reaction means when said drawer is in said retracted position and operable as an incident of engagement with said support means to lift said drawer upwardly from the base and concurrently urge said drawer onto said support means and away from said retracted position toward said exposed position.

15. The refuse compactor means of claim 14 wherein said support means includes a roller carried by said base, said roller movably supporting the drawer when the drawer is in other than said retracted position, and releasably retaining said drawer in said retracted position prior to operation of said operating member to draw the drawer upwardly from the base and urge said drawer forwardly therefrom.

16. The refuse compactor means of claim 14 further including biasing means for urging the drawer toward said exposed position outwardly from said retracted position.

* * * * *